US008599099B2

(12) United States Patent
Park

(10) Patent No.: US 8,599,099 B2
(45) Date of Patent: Dec. 3, 2013

(54) ANTENNA SYSTEM

(75) Inventor: Byung-Tae Park, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 292 days.

(21) Appl. No.: 12/271,231

(22) Filed: Nov. 14, 2008

(65) Prior Publication Data

US 2009/0128444 A1 May 21, 2009

(30) Foreign Application Priority Data

Nov. 15, 2007 (KR) ..... 10-2007-0116699

(51) Int. Cl.

| | |
|---|---|
| ***H01Q 1/12*** | (2006.01) |
| ***H01Q 1/08*** | (2006.01) |
| ***H01Q 3/02*** | (2006.01) |
| ***H01Q 3/00*** | (2006.01) |
| ***H01Q 1/24*** | (2006.01) |

(52) U.S. Cl.

USPC ..... 343/890; 343/878; 343/880; 343/882; 343/888; 343/757; 343/702

(58) Field of Classification Search

USPC ..... 343/890, 878, 880, 882, 888, 757, 702

See application file for complete search history.

(56) References Cited

U.S. PATENT DOCUMENTS

| | | | | | |
|---|---|---|---|---|---|
| 1,806,350 | A | * | 5/1931 | Hire | 434/302 |
| 2,204,026 | A | * | 6/1940 | Wilhelm | 343/874 |
| 3,024,358 | A | * | 3/1962 | Grady, Jr. | 441/30 |
| 3,487,484 | A | * | 1/1970 | Holmes | 441/28 |
| 4,365,421 | A | * | 12/1982 | Byrum | 33/366.21 |
| H0001560 | H | * | 7/1996 | Gill et al. | 342/385 |
| 7,027,008 | B2 | * | 4/2006 | Baker | 343/890 |
| 7,098,864 | B2 | * | 8/2006 | Ryan | 343/890 |

FOREIGN PATENT DOCUMENTS

| | | | |
|---|---|---|---|
| KR | 10-2000-0000258 | A | 1/2000 |
| KR | 10-2001-0084810 | A | 9/2001 |

* cited by examiner

*Primary Examiner* — Jacob Y Choi
*Assistant Examiner* — Graham Smith
(74) *Attorney, Agent, or Firm* — Jefferson IP Law, LLP

(57) ABSTRACT

An antenna system is provided. The antenna system includes an antenna connected to a signal transmitting/receiving circuit to transmit and receive a radio signal, an antenna pole coupled to the antenna, a central weight unit coupled to the antenna pole to keep a beam pattern of the antenna in a certain direction with respect to a gravity direction and formed in a curved figure, and an antenna coupling unit formed in a recess to support the central weight unit.

15 Claims, 3 Drawing Sheets

ANTENNA SYSTEM

PRIORITY

This application claims the benefit under 35 U.S.C. §119 (a) of an Korean patent application filed in the Korean Industrial Property Office on Nov. 15, 2007 and assigned Serial No. 2007-116699, the entire disclosure of which is hereby incorporated by reference.

BACKGROUND OF THE INVENTION

1. Field of the Invention

The present invention relates to an antenna system. More particularly, the present invention relates to an antenna system having an antenna kept in a certain direction with respect to a gravity direction.

2. Description of the Related Art

Generally, a signal transmitting/receiving circuit transmits and receives a signal using an antenna during signal transmission. The signal transmitting/receiving circuit is provided in a Base Station (BS), a Relay Station (RS) and a Mobile Station (MS).

The antenna is a device for transmitting and receiving a signal via a free space, such as an air interface, for radio communications.

FIG. 1 is a schematic diagram illustrating a ship transmitting and receiving a signal through a conventional antenna.

Referring to FIG. 1, the ship is placed at sea level and is equipped with an antenna, which is connected to a signal transmitting/receiving circuit provided on the ship to transmit and receive a signal.

Since the antenna of the signal transmitting/receiving circuit is fixed to the ship along with the signal transmitting/receiving circuit, the antenna moves according to movement of the ship, which may be caused by waves or the like.

In general, an antenna forms a beam in a particular direction, wherein the formed beam refers to a direction, shape and position of specific electromagnetic waves which can transmit and receive a signal. In particular, the beam has a specific orientation and shape, and the shape of the beam is referred to as a beam pattern or a radiation pattern.

The signal transmitting/receiving circuit transmits and receives a signal through the antenna. Namely, the signal transmitting/receiving circuit detects a signal through beams of the antenna.

In general, antennas include a non-directional antenna and an omni-directional antenna. The non-directional antenna forms beams in all directions, for example, from an upper direction to a lower direction with respect to the antenna, and a type of the non-directional antenna is an isotropic antenna. However, the isotropic antenna is a so-called theoretical antenna, and therefore, most of the antennas have a beam pattern.

One example of the antennas, which have a beam pattern, is an omni-directional antenna. The omni-directional antenna has a beam pattern which spreads evenly sideways, rather than in an upper direction or a lower direction, and therefore, is effective for use at the ground level.

Herein, it is assumed that the antenna discussed below is an omni-directional antenna.

The antenna provided on the ship forms beam patterns 111 and 113 corresponding to its orientation which changes due to waves.

As illustrated in FIG. 1, reception signals which will be received via the antenna are indicated by arrows. In FIG. 1, it is noted that beam patterns 111 and 113 are not formed in such a direction that the reception signals are correctly received due to movement of the antenna. Thus, signal transmitting/receiving ability of the antenna becomes deteriorated.

Therefore, a need exists for an antenna for forming a correct beam pattern in response to movement of the antenna, thereby improving the signal transmitting/receiving ability.

SUMMARY OF THE INVENTION

An aspect of the present invention is to address the above-mentioned problems and/or disadvantages and to provide at least the advantages described below. Accordingly, an aspect of the present invention is to provide an antenna system allowing an antenna to form a correct beam pattern in response to movement of the antenna, thereby improving signal transmitting/receiving ability.

In accordance with an aspect of the present invention, an antenna system is provided. The antenna system includes an antenna connected to a signal transmitting/receiving circuit for transmitting and receiving a radio signal, an antenna pole coupled to the antenna, a central weight unit coupled to the antenna pole for keeping a beam pattern of the antenna in a certain direction with the respect to a gravity direction and formed in a curved figure, and an antenna coupling unit formed with a recess for supporting the central weight unit.

In accordance with another aspect of the present invention, an antenna system is provided. The antenna system includes an antenna connected to a signal transmitting/receiving circuit for transmitting and receiving a radio signal, an antenna pole coupled to the antenna, a central weight unit coupled to the antenna pole for keeping a beam pattern of the antenna in a certain direction with respect to a gravity direction and formed in a curved figure, an antenna box surrounding the central weight unit and a part of the antenna pole, and an antenna position maintaining unit provided on the top side of the antenna box for tilting the beam pattern of the antenna in a preset range with respect to the gravity direction, wherein the antenna position maintaining unit includes a coupling unit formed in a ring shape and arranged to have the antenna pole passed through the inside of the coupling unit, and a plurality of tension lines connecting the coupling unit to the antenna box.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings, in which.

Throughout the drawings, like reference numerals will be understood to refer to like parts, components and structures.

DETAILED DESCRIPTION OF THE EXEMPLARY EMBODIMENTS

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions will be omitted for clarity and conciseness.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Exemplary embodiments of the present invention are to address an antenna system. In particular, exemplary embodiments of the present invention relate to an antenna system for forming a beam pattern of an antenna in a certain direction with respect to a gravity direction. The antenna system of exemplary embodiments the present invention is applicable to any device that transmits and receives a signal using an antenna.

The antenna system of exemplary embodiments the present invention is connected to a signal transmitting/receiving circuit using an antenna included in the antenna system. Here, the signal transmitting/receiving circuit refers to a circuit adapted to transmit and receive a signal directly via the antenna, and it can be provided in a Base Station (BS), a Relay Station (RS) and a Mobile Station (MS), for example. The antenna system is provided in any device such as vehicles, ships, airplanes and other devices which require transmission and reception of a signal. For the convenience of explanation, it is, hereinafter, assumed that the antenna system is positioned in a ship.

Figure 2:
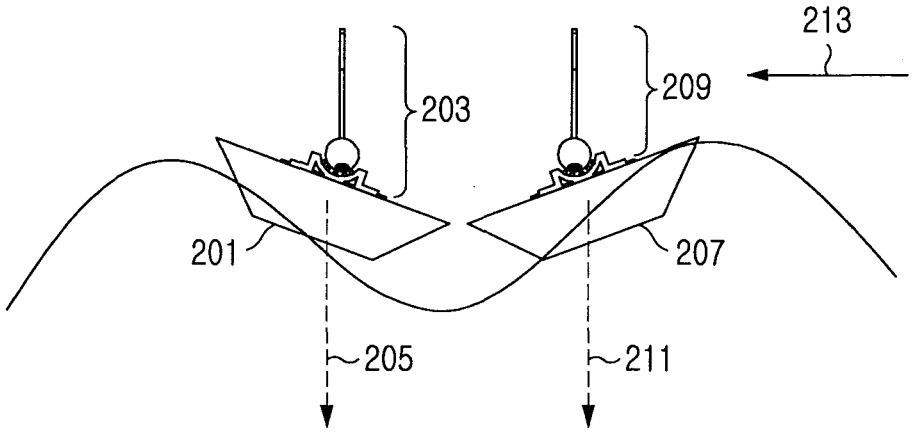
FIG. 2 is a schematic diagram illustrating transmission and reception of a signal in an antenna system according to an exemplary embodiment of the present invention.

FIG. 2 is a schematic diagram showing transmission and reception of a signal using an antenna in an antenna system, according to an exemplary embodiment of the present invention.

Figure 1:
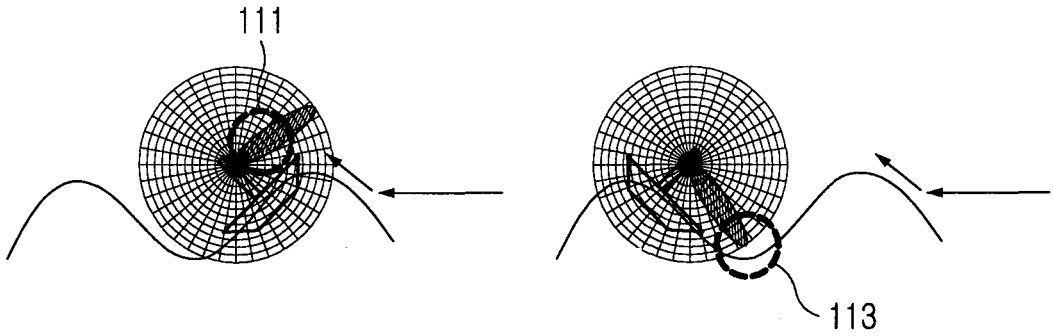
FIG.1 (CONVENTIONAL ART)
FIG. 1 is a schematic diagram illustrating transmission and reception of a signal using a conventional antenna.

Referring to FIG. 2, ships 201 and 207 each use antenna systems 203 or 209 respectively. The ships 201 and 207 are placed at sea level, similar to the placement of the ship as illustrated in FIG. 1. Also, antennas are installed on the ships 201 and 207 to transmit and receive a signal.

The antenna systems 203 and 209 maintain a beam pattern of the antenna in a certain direction with respect to the gravity direction regardless of movement of the ships 201 and 207, respectively. For example, the antenna as described above forms a beam in a particular direction.

Herein, it is assumed that the antenna is an omni-directional antenna, for the convenience of explanation. However, the present invention is not limited to an omni-direction antenna, but can be applied to any other antenna having a specific beam pattern.

The antenna moves in gravity directions 205 and 211 according to movement of the waves. As illustrated in FIG. 2, a reception signal 213 which is received at the antenna is, for example, indicated by an arrow. The antenna in the antenna system of an exemplary embodiment of the present invention maintains a beam pattern of the antenna in a certain direction with respect to the gravity direction, regardless of the change of the position of the ship 201, and therefore, the beam pattern of the antenna is formed correctly. That is, the antenna system maintains the beam pattern of the antenna in a certain direction with respect to the gravity direction, thereby improving signal transmitting/receiving ability. Hereinafter, the antenna system will be described with reference to FIG. 3.

Figure 3:
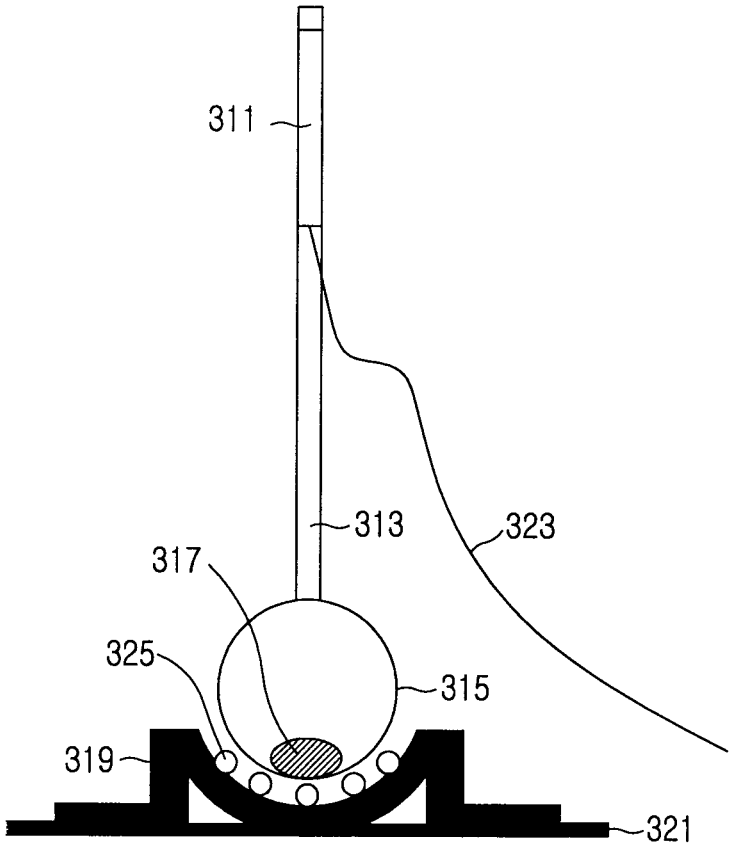
FIG. 3 illustrates a structure of an antenna system according to an exemplary embodiment of the present invention.

FIG. 3 illustrates a construction of an antenna system according to an exemplary embodiment of the present invention.

Referring to FIG. 3, the antenna system includes an antenna 311, an antenna cable 323, and an antenna position maintaining unit for adjusting movement of the antenna to keep a beam pattern of the antenna in a certain direction with respect to the gravity direction.

The antenna position maintaining unit includes an antenna pole 313, a central weighting unit 315 and an antenna coupling unit 321. Here, the antenna position maintaining unit is coupled to the antenna 311.

The central weight unit 315 maintains a constant position with respect to the gravity direction, and has a curved figure, which may be, for example, one of a round shape and an oval shape.

The central weight unit 315 includes a poise 317 which moves in the gravity direction. The poise 317 is placed inside the central weight unit 315, and moves in the gravity direction irrespective of movement of the outer environment. The poise 317 includes material in a liquid state or a solid state, such as mercury, water, a spherical figure (for example, a bead and an iron bead), etc.

The antenna pole 313 is fixed to the central weight unit 315 and interconnects the antenna 311 and the central weight unit 315. An example of the antenna pole is a column type. In addition, the antenna pole 313 may have a variable length, for example, depending on a system condition or settings, and otherwise has a fixed length to maximize ability of the antenna. Also, the antenna pole 313 may be directed in the gravity direction irrespective of movement of the outer environment.

Still referring to FIG. 3, the antenna 311 according to an exemplary embodiment of the present invention is connected to the central weight unit 315 through the antenna pole 313. Alternatively, the antenna 311 may be directly connected to the central weight unit 315 without using the antenna pole 313.

The antenna coupling unit 321 connects an apparatus having the antenna system to the central weight unit 315, and is formed to have a concave recess 319. For instance, the apparatus having the antenna system includes a vehicle, a ship, an airplane and other apparatus having any signal transmitting/receiving circuit. Also, a plurality of bearings 325 are included on a coupling surface between the central weight unit 315 and the antenna coupling unit 321. The plurality of bearings 325 minimizes frictional force exerted between the central weight unit 315 and the antenna coupling unit 321 when the central weight unit 315 moves in the gravity direction. Furthermore, it is possible that a lubricant may be added among the plurality of bearings 325, minimizing the frictional force between the antenna coupling unit 321 and the central weight unit 315.

The antenna cable 323 transmits a signal from a signal transmitting/receiving circuit to the antenna 311, and transmits a signal received through the antenna 311 to the signal transmitting/receiving circuit. The antenna cable 323 interconnects the antenna 311 and the signal transmitting/receiving circuit so that the signal transmitting/receiving circuit may transmit and receive a signal via the antenna 311.

Figure 4:
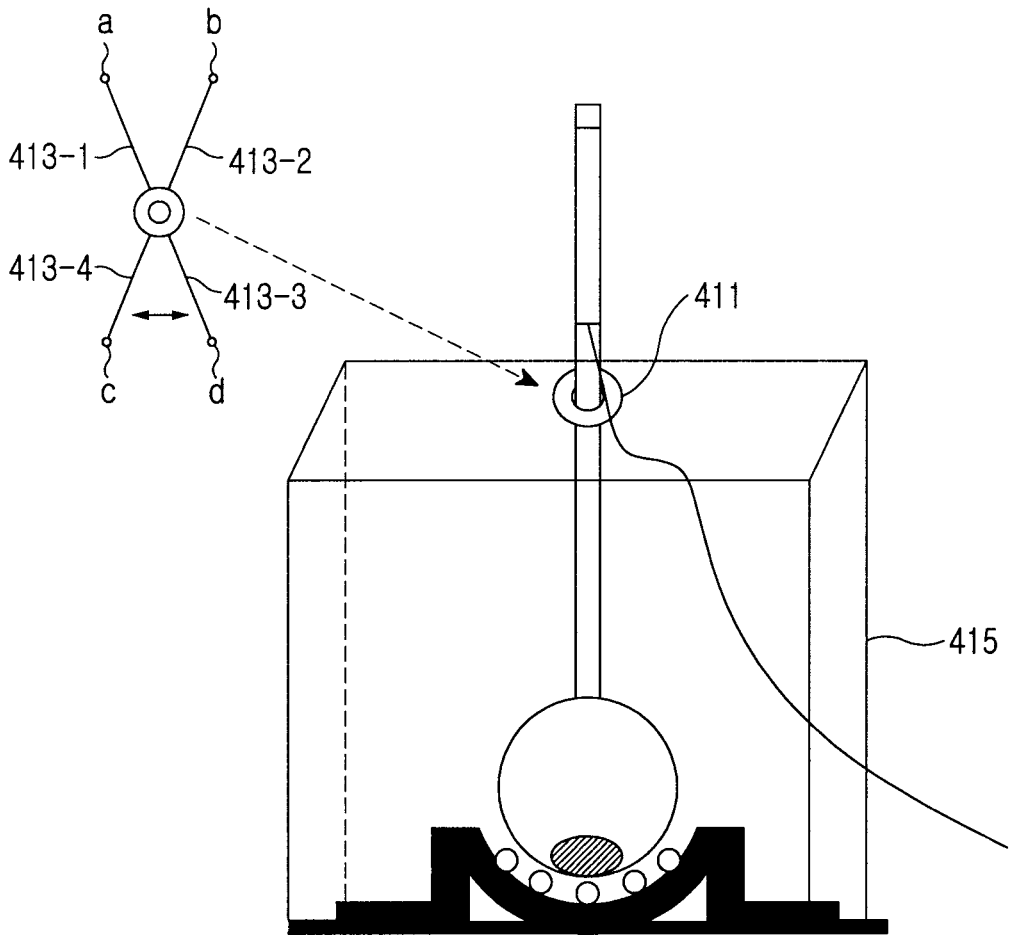
FIG. 4 illustrates an antenna box for maintaining a position of an antenna according to an exemplary embodiment of the present invention.

FIG. 4 illustrates an antenna box for maintaining the position of an antenna according to an exemplary embodiment of the present invention.

Referring to FIG. 4, an antenna system according to an exemplary embodiment of the present invention includes an antenna box 415. The antenna box 415 has an antenna position maintaining unit in its center, and it surrounds the antenna pole 313 and the central weight unit 315. In this exemplary embodiment, the height of the antenna box is adjustable.

The antenna box 415 includes an antenna position maintaining joint 411. The antenna position maintaining joint 411 includes a coupling unit (not shown), which is coupled to the antenna pole 313, and at least one of tension lines 413-1, 413-2, 413-3 and 413-4. The coupling unit (not shown) has a ring shape, and the antenna pole 313 is placed inside of the coupling unit. The tension lines 413-1, 413-2, 413-3 and 413-4, respectively, are made of a linear material, such as a wire, a thread and a cable, or an elastic material such as a rubber band.

The antenna position maintaining joint 411 is coupled to the antenna pole 313 so that excessive tilting of the antenna position maintaining unit is prevented. The antenna position maintaining joint 411 prevents the antenna 311 from being excessively tilted due to acceleration resulting from the fast movement of an apparatus having the antenna system, and prevents the antenna 311 from being excessively tilted because of wind and the like. It is understood that the antenna position maintaining joint 411 permits the antenna 311 to be tilted in a preset range, thereby improving signal transmitting/receiving ability of the antenna 311. The preset range herein may be a variety of variable values depending on system conditions, the characteristics of an antenna and user's settings.

The tension lines 413-1, 413-2, 413-3 and 413-4 control the position of the coupling unit so that the antenna 311 connected to the antenna pole 313 can be tilted in a preset range.

The end parts a, b, c and d of each side of the tension lines 413-1, 413-2, 413-3 and 413-4 may be connected to a tension adjusting device (not shown) in order that the antenna position maintaining joint 411 as described above is placed in a certain range or an antenna box 415 which is installed by setting the antenna position maintaining unit 411 in a center point thereof. The end parts of the other side of the tension lines 413-1, 413-2, 413-3 and 413-4 are connected to the antenna pole 313.

The tension adjusting device (not shown) includes a sensor or the like, and may detect movement of the antenna 311 and a variation in the position of an apparatus having the antenna system by using the sensor. The tension adjusting device (not shown) adjusts the length of each of the tension lines 413-1, 413-2, 413-3 and 413-4 to prevent the antenna 311 from abruptly moving around when the sensor has detected movement of the antenna or a variation in the position of the apparatus. The tension adjusting device (not shown) can be included in the antenna box 415.

Consequently, the antenna system according to exemplary embodiments of the present invention can maintain the direction of a beam pattern of an antenna regardless of vibration such as waves or movement of an apparatus having the antenna system, preserving a signal transmitting/receiving ability. Also, an antenna communication system according to exemplary embodiments of the present invention may maintain a radius of communication of an antenna even if there is movement of the antenna, thereby preventing the reduction of cell radius (that is, coverage area).

Hereinafter, the performance of an antenna system according to the present invention will be set forth in Table 1 below.

TABLE 1

| Wireless Environment | Conventional Antenna | Proposed Antenna |
|---|---|---|
| CINR (dB) | 25 | 28 |
| RSSI (dBm) | −49 | −46 |
| Transmission Power (uplink) (dB) | 15 | 12 |
| Picture Interruption in Picture Transmission | Occasionally Occurred | Hardly Occurred |

Referring to Table 1, a comparison result of between a conventional antenna and an antenna of exemplary embodiments of the present invention is shown. The same antenna was used, and the shown result was obtained in the substantially same environment.

The above result has indicated that an antenna according to exemplary embodiments of the present invention has improved by 3 dB for Carrier to Interference and Noise Ratio compared to the conventional antenna. When the improved Carrier to Interference and Noise Ratio of 3 dB by exemplary embodiments of the present invention is reflected in transmission power, the same effect as twice the transmission power gain may be given.

Also, the result has indicated that there is a difference of −3 dB in Receive Signal Strength Indicator (RSSI), and an exemplary embodiment of the present invention has a profit of about 3 dB in transmission power. In Table 1, the transmission power is uplink transmission power, that is, it is transmission power required when the signal transmitting/receiving circuit transmits a signal.

Furthermore, a picture interruption phenomenon, which takes place in transmission of picture data (that is, image data), hardly occurs in the antenna according to exemplary embodiments of the present invention, whereas it frequently occurred in the conventional antenna.

Finally, exemplary embodiments of the present invention have improved gain of transmitting/receiving signals which has been decreased due to the tilting of an antenna. In other words, exemplary embodiments of the present invention have improved transmitting/receiving ability of an antenna using a so-called tumbling doll principle which directs a beam pattern of an antenna in a certain direction with respect to the gravity direction.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An antenna system, the system comprising:

an antenna connected to a signal transmitting and receiving circuit for transmitting a radio signal and receiving another radio signal;

an antenna pole coupled to the antenna;

a spherical central weight unit coupled to the antenna pole for keeping a beam pattern of the antenna in a certain direction on the basis of a gravity direction;

an antenna coupling unit formed with a recess for supporting the central weight unit; and an antenna position maintaining joint coupled to the antenna pole, and comprising a coupling unit which is coupled to the antenna pole and at least one of tension lines so as to prevent the antenna from being tilted, wherein the antenna pole directly contacts and outwardly extends away from an outside surface of the central weight unit, wherein a first end of the antenna pole is directly connected to the central weight unit and a second end of the antenna pole is directly connected to the antenna, wherein the first end of the antenna pole and the second end of the antenna pole are disposed opposite to each other along a length of the antenna pole, and wherein the antenna coupling unit is configured to connect to an apparatus having the antenna system and to the central weight unit.

2. The system as claimed in claim 1, wherein the central weight unit comprises at least one of a circular shape and an oval shape, and comprises a poise which moves in the gravity direction.

3. The system as claimed in claim 2, wherein the poise is placed inside the central weight unit.

4. The system as claimed in claim 3, wherein the poise is material in a liquid state or a solid state.

5. The system as claimed in claim 1, wherein the antenna pole maintains its position in the gravity direction.

6. The system as claimed in claim 1, further comprising a plurality of bearings to minimize frictional force between the central weight unit and the antenna coupling unit.

7. The system as claimed in claim 1, wherein the antenna coupling unit comprises a concave shape.

8. An antenna system, the system comprising:

an antenna connected to transmitting and receiving circuit for transmitting a radio signal and receiving another radio signal;

an antenna pole coupled to the antenna;

a spherical central weight unit coupled to the antenna pole for keeping a beam pattern of the antenna in a certain direction on the basis of a gravity direction;

an antenna box surrounding the central weight unit and a part of the antenna pole;

an antenna position maintaining unit provided in an opening of a top side surface of the antenna box for tilting the beam pattern of the antenna in a range of angular position with respect to the gravity direction;

an antenna coupling unit formed with a recess for supporting the central weight unit; and wherein the antenna box includes an antenna position maintain joint, and the antenna position maintaining joint includes a coupling unit which is coupled to the antenna pole and at least one of tension lines so as to prevent the antenna from being tilted, wherein the antenna position maintaining unit includes a coupling unit formed in a ring shape and arranged to have the antenna pole passed through the inside of the coupling unit, and a plurality of tension lines connecting the coupling unit to the antenna box, wherein a first end of the antenna pole is directly connected to the central weight unit and a second end of the antenna pole is directly connected to the antenna, wherein the first end of the antenna pole and the second end of the antenna pole are disposed opposite to each other along a length of the antenna pole, and wherein the antenna coupling unit is configured to connect to an apparatus having the antenna system and to the central weight unit.

9. The system as claimed in claim 8, wherein the central weight unit comprises at least one of a circular shape and an oval shape, and comprises a poise which moves in the gravity direction.

10. The system as claimed in claim 9, wherein the poise is placed inside the central weight unit.

11. The system as claimed in claim 10, wherein the poise is material in a liquid state or a solid state.

12. The system as claimed in claim 8, wherein the antenna pole maintains a position parallel to the gravity direction.

13. The system as claimed in claim 8, further comprising a tension adjusting device which adjusts the tension of each of the tension lines in order to adjust the range of angular position.

14. The system as claimed in claim 8, wherein the tension lines control a position of the coupling unit so that the antenna connected to the antenna pole can be tilted in the range of angular position.

15. The system as claimed in claim 14, wherein an end part of each side of the tension lines is connected to a tension adjusting device to adjust the length of each of the tension lines.

* * * * *